United States Patent [19]

Kenney

[11] 4,250,755

[45] Feb. 17, 1981

[54] PIPETTE

[75] Inventor: James W. Kenney, West Chester, Pa.

[73] Assignee: Drummond Scientific Co., Broomall, Pa.

[21] Appl. No.: 86,773

[22] Filed: Oct. 22, 1979

[51] Int. Cl.[3] ..... B01L 3/02

[52] U.S. Cl. ..... 73/425.6

[58] Field of Search ..... 73/425.4 P, 425.6; 222/309

[56] References Cited

U.S. PATENT DOCUMENTS

| | | | |
|---|---|---|---|
| 4,098,125 | 7/1978 | Lee | 73/425.6 |
| 4,128,009 | 12/1978 | D'Autry | 73/425.6 |
| 4,141,250 | 2/1979 | D'Autry | 73/425.6 |
| 4,165,646 | 8/1979 | Shapiro | 73/425.6 |

*Primary Examiner*—S. Clement Swisher

*Attorney, Agent, or Firm*—Harding, Earley & Follmer

[57] ABSTRACT

A pipette has an elongated body having a bore extending to the opposite ends thereof. A tube is secured to one end of the body. A plunger extends through the body with one end extending into the tube to draw liquid into the tube and discharge it from the tube. A first stop member is mounted on the plunger for rotation with the plunger and is axially movable relative to the plunger. This stop member is threaded to the body within the bore. A second stop member is mounted on the plunger and a spring biases this stop member towards the first stop member. A counter is driven by the rotation of the plunger.

8 Claims, 12 Drawing Figures

PIPETTE

TECHNICAL FIELD

This invention is in the field of fluid measurement and dispensing.

BACKGROUND OF THE PRIOR ART

Pipettes incorporating hand actuated plungers are well-known to the art. They are widely used, for example, in the medical field for transferring serum and in the chemical field for transferring liquids such as in liquid chromatography. It is also known to have such pipettes with adjustable stop means to limit the travel of the plunger and thus regulate the amount of liquid dispensed from the pipette. In one pipette a threaded stop member has a bore receiving a plunger which has a cooperating stop member. The threaded stop member has an exposed portion which can be turned by the operator's hand to adjust the position of the stop member and, hence, the amount of liquid dispensed. A counter is driven by the stop member and indicates to the operator the volume of liquid which will be picked up and dispensed.

It is frequently necessary to pick up and dispense different amounts of liquid in rapid succession which is difficult to accomplish with the above-described pipette since the member for setting the stop is different from the plunger. In accordance with the invention, this problem is eliminated by using the plunger not only to pick up and discharge liquid, but also to set the stop to a desired position indicated by a counter.

BRIEF SUMMARY OF THE INVENTION

A pipette has an elongated body having a bore extending to the opposite ends thereof. A tube is secured to one end of the body. A plunger extends through the body with one end extending into the tube to draw liquid into the tube and discharge it from the tube. A first stop member is mounted on the plunger for rotation with the plunger and is axially movable relative to the plunger. This stop member is threaded to the body within the bore. A second stop member is mounted on the plunger and a spring biases this stop member towards the first stop member. A counter is driven by the rotation of the plunger.

DETAILED DESCRIPTION

Figure 1:
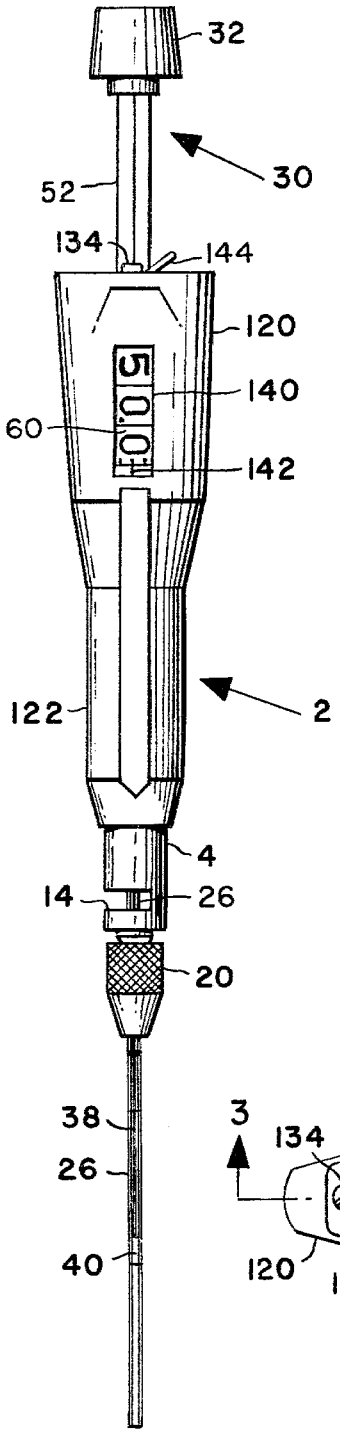
FIG. 1 is a side elevational view of a pipette in accordance with the invention.

A pipette 2 in accordance with the invention has a barrel 4 with a bore 6 containing a shoulder 8 adjacent a reduced diameter portion 12 of bore 6. A slot 14 cuts partially through barrel 4 adjacent threaded end 16 which is engaged threadably by a collet 20 containing a rubber ring 22. A glass capillary tube 26 has one end adjacent reduced diameter portion 12 of bore 6 where it is held by ring 22 of collet 20.

A plunger 30 has a cap 32 secured to its upper end by a screw 34. Plunger 30 passes through bore 6 and has a reduced diameter portion 38 carrying a piston 40 inside of tube 26. Plunger 30 is biased upwardly by a compression coil spring 42 having one end abutting shoulder 8 and the other end abutting a stop member 44 secured to plunger 30. Stop member 44 is biased by spring 42 towards stop member 48 which threadably engages threads 50 inside barrel 4. Stop member 48 has a hexagonal opening 50 which is engaged by a hexagonal portion 52 of plunger 30 which extends from cap 32 to stop 44. Thus, stop member 48 will rotate with plunger 30 while plunger 30 is free to move axially without moving stop 48.

Figure 3:
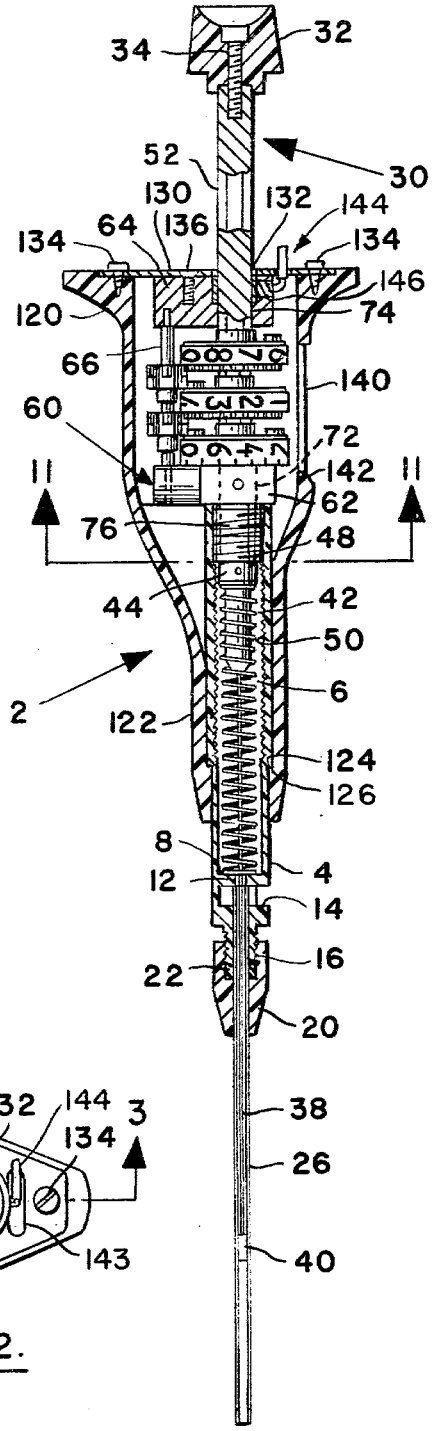
FIG. 3 is a front elevational view of the pipette of FIG. 1.

A counter 60 has a pair of opposed blocks 62 and 64 connected by a rod 66. Blocks 62 and 64 have openings 72 and 74 respectively for the free passage of plunger 30. Block 62 has a hollow externally threaded boss 76 which is threaded to the interior of barrel 4. Boss 76 acts to limit the upward movement of stop 48 as shown in FIG. 3 where stop 48 is abutting boss 76.

Figure 7:
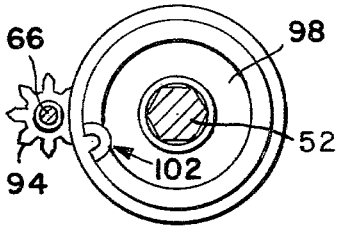
FIG. 7 is a view taken on the plane indicated by the line 7—7 in FIG. 4.
Figure 8:
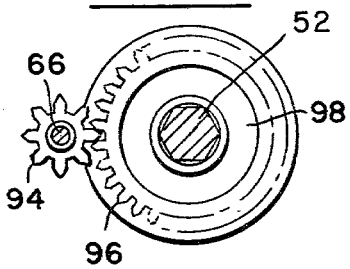
FIG. 8 is a view taken on the plane indicated by the line 8—8 in FIG. 4.
Figure 5:
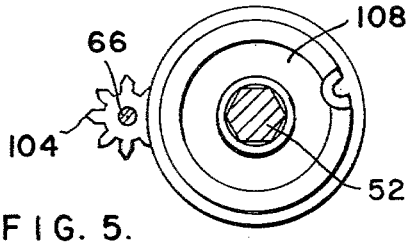
FIG. 5 is a view taken on the plane indicated by the line 5—5 in FIG. 4.
Figure 9:
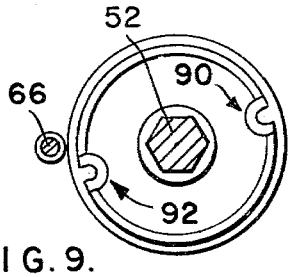
FIG. 9 is a view taken on the plane indicated by the line 9—9 in FIG. 4.
Figure 6:
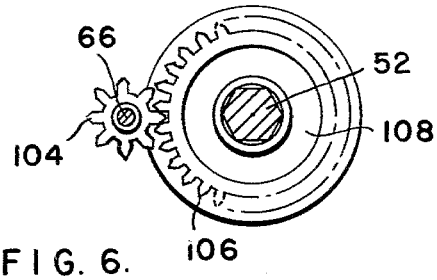
FIG. 6 is a view taken on the plane indicated by the line 6—6 in FIG. 4.
Figure 10:
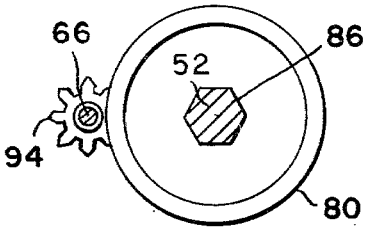
FIG. 10 is a view taken on the plane indicated by the line 10—10 in FIG. 4.
Figure 12:
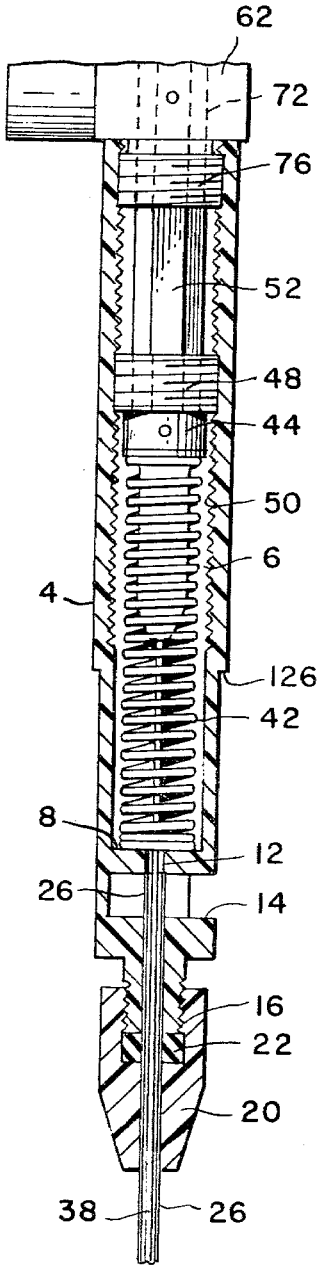
FIG. 12 is a sectional view of the barrel and plunger of the pipette of FIG. 1 with the adjustable stop in an intermediate position in the barrel.
Figure 11:
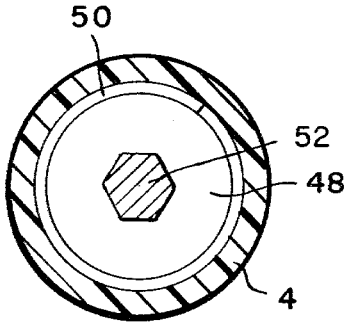
FIG. 11 is a sectional view of the barrel and plunger of the pipette of FIG. 1 taken on the plane indicated by the line 11—11 in FIG. 2.

Counter 60 is calibrated to give volume readings from 500 to 0 microliters. It has a counter wheel 80 with 20 indicia 82 and two series of the numerals 0, 2, 4, 6 and 8. As shown in FIG. 10, wheel 80 has a hexagonal opening 86 through which the hexagonal portion of plunger 30 passes so that wheel 80 will rotate with plunger 30 while permitting the plunger to move axially with respect to wheel 80. Wheel 80 has a tooth pair 90 and a tooth pair 92 (FIG. 9) adapted to rotate in either direction a gear 94 (FIG. 10) mounted for free rotation on rod 66. Gear 94 engages a 360° gear ring 96 on wheel 98 (FIG. 8) which carries equally spaced numerals 1, 2, 3, 4, 5, 6, 7, 8, 9 and 0. Wheel 98 has a single tooth pair 102 (FIG. 7) which is adapted to engage and rotate in either direction a gear 104 mounted on rod 66. Wheel 98 is mounted for free rotation on plunger 30. Gear 104 in turn engages a ring gear 106 on wheel 108 (FIG. 6) which is mounted for free rotation on plunger 30. Wheel 108 carries the equally spaced numerals 1, 2, 3, 4, 5, 6, 7, 8, 9 and 0.

The numbers on wheels 80, 98 and 108 are in units, tens and hundreds of microliters with the indicia 82 on wheel 80 graduated in 0.5 microliters.

Figure 2:
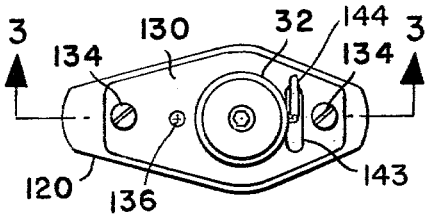
FIG. 2 is a top plan view of the pipette of FIG. 1.
Figure 4:
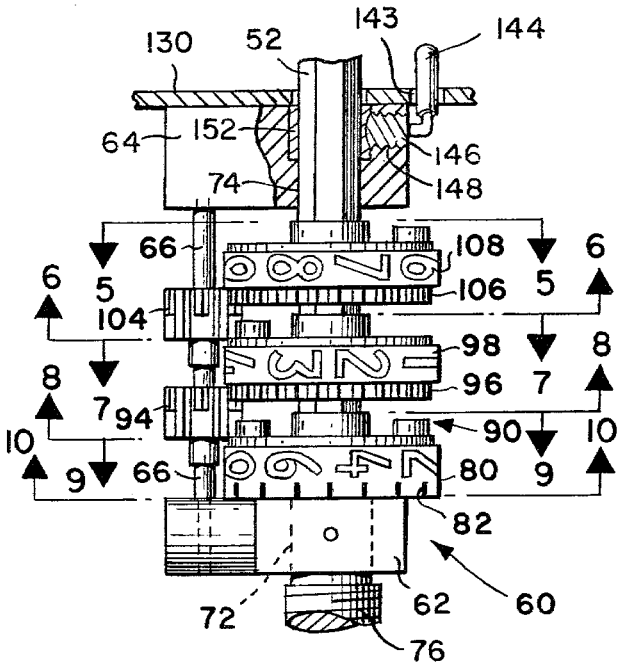
FIG. 4 is an elevational view, partially broken away, of the counter of the pipette of FIG. 1 with the housing removed.

A housing 120 overlies counter 60 and has a reduced diameter portion 122 which slides over barrel 4. Housing 120 has a step 124 engaged by a step 126 on barrel 4. A plate 130 has an opening 132 for the free passage of plunger 30 and is secured to the upper end of housing 120 by screws shown at 134 and to block 64 by screw shown at 136. Housing 120 has a window 140 with an indicator mark 142 for the reading of counter 60. Plate 130 has an opening 143 accommodating a right-angled lever 144 (FIG. 4) which has a threaded portion 146 in a threaded opening 148 in block 64. Opening 148 communicates with opening 74 and threaded portion 148 is adapted to engage a resilient locking collar 152 of spring steel surrounding plunger 30 in opening 74. In the position shown in FIGS. 2 and 3, lever 144 is in the locking position with the threaded portion screwed in forcing the locking collar 152 against hexagonal portion 52 of plunger 30 to lock it against rotation at the desired setting while still permitting the plunger to move freely axially.

When cap 32 is rotated counterclockwise as viewed in FIG. 3 until stop member 48 bears against boss 76 to provide for the maximum amount of fluid in tube 26, counter 60 will read 500 microliters. When cap 32 is rotated as far as possible in the other direction to screw stop 48 further into bore 6 and bringing cap 32 into contact with plate 130, the counter 60 will read 0 microliters since the tube 26 can hold no liquid with stop 48 in this position.

OPERATION

In operation, with lever 144 in the unlocked position, cap 32 is rotated to rotate stop 48 in tube 4 to the desired position where counter 60 viewed through window 140 shows the desired microliters of fluid to be withdrawn and discharged. Once the stop 48 has been properly set, cap 32 is depressed until it comes in contact with plate 130 causing the outer end of piston 4 to pass the outer end of tube 26. Tube 26 is then placed into the liquid supply. Cap 32 is then released permitting spring 42 to move plunger 30 upwardly causing liquid to be withdrawn into tube 26 until stop member 44 engages stop member 48 to prevent the further withdrawal of liquid into tube 26. The pipette is then moved to a position where it is desired to discharge the liquid in tube 26 and plunger 30 is then depressed until cap 32 engages plate 130 to expel the contained liquid. If the pipette is to be used repeatedly at the same setting, lever 144 may be placed in the locked position to insure against a change in the volume setting. The entire operation can be carried out with one hand if desired which is very advantageous when numerous changes in the volume setting are required.

It will be understood that the above-described embodiment is illustrative and is not intended to be limiting.

I claim:

1. A pipette comprising:

an elongated body having a threaded bore, a tube secured to one end of the body, a plunger extending through the body with one end extending into said tube to draw liquid into the tube and discharge it from the tube, a first adjustable stop threaded in said bore and on said plunger for rotation with the plunger for adjusting its position in the bore, said stop member and said plunger being relatively movable with respect to each other on a common axis, a second stop mounted on the plunger between said first stop member and the said one end of the body, a spring biasing the second stop towards the first stop, a counter driven by the rotation of the plunger, said plunger being movable on its axis relative to the counter.

2. A pipette in accordance with claim 1 in which the counter is removably secured to the body.

3. A pipette in accordance with claim 1 or claim 2 having a housing for the counter.

4. A pipette in accordance with claim 1 or claim 2 in which the counter has a first counter wheel secured to the plunger for rotation therewith and axial movement relative to the plunger, and a second counter wheel mounted for free rotation on the plunger and drive means between the first counter wheel and the second counter wheel.

5. A pipette in accordance with claim 1 or claim 2 having a lock cooperating with the plunger for locking the plunger against rotation.

6. A pipette in accordance with claim 5 in which the lock comprises a collar around the plunger and a threaded member engaging said collar.

7. A pipette comprising:

an elongated body having a threaded bore, a tube secured to one end of the body, a plunger extending through the bore with one end extending into said tube to draw liquid into the tube and discharge it from the tube, a first adjustable stop threaded in said bore and splined on said plunger for rotation with the plunger for adjusting its position in the bore and for relative movement with the plunger on a common axis, a second stop mounted on the plunger between the first stop and said one end of the body, a compression coil spring in the bore biasing the second stop towards the first stop, a counter having a driving and a driven counter wheel mounted on a frame secured to said body, said driving counter wheel being splined on said plunger for rotation therewith and for relative movement of the plunger on its axis with respect to the counter and said driven counter wheel being mounted for free rotation on the plunger, and a housing for the counter.

8. A pipette in accordance with claim 7 having a friction lock for holding the plunger from rotating and changing the position of the first stop comprising a resilient collar around the plunger and a threaded member engaging the collar.

* * * * *